US005114499A

United States Patent [19]

Kusunoki

[11] Patent Number: 5,114,499

[45] Date of Patent: May 19, 1992

[54] METHOD OF FORMING CHILLED LAYER

[75] Inventor: Hiroaki Kusunoki, Otake, Japan

[73] Assignee: Mazda Motor Corporation, Hiroshima, Japan

[21] Appl. No.: 664,137

[22] Filed: Mar. 4, 1991

[30] Foreign Application Priority Data

Mar. 5, 1990 [JP] Japan ..... 2-53100
May 21, 1990 [JP] Japan ..... 2-131640

[51] Int. Cl.[5] ..... C21D 1/09

[52] U.S. Cl. ..... 148/512; 219/121.16; 219/121.65; 219/121.66; 219/123; 219/76.15; 219/76.14; 148/565; 148/572; 148/903; 148/904

[58] Field of Search ..... 148/1, 4, 134, 152, 148/155, 157, 902, 903, 904; 219/121.7, 121.36, 121.85, 121.35, 121.16, 121.65, 121.66, 123, 76.5, 76.15

[56] References Cited

U.S. PATENT DOCUMENTS 4,190,760 2/1980 Kano et al. ..... 219/123
4,652,724 3/1987 Morita et al. ..... 219/121.85

FOREIGN PATENT DOCUMENTS 0140249 12/1978 Japan .
58-196362 11/1983 Japan .
0204834 10/1985 Japan .
60-258421 12/1985 Japan .
6117372 1/1986 Japan .
0449456 11/1974 U.S.S.R. .

OTHER PUBLICATIONS

Applicant's Admission on p. 2, Line 13 to p. 3, Line 2 (Japanese Unexamined Patent Publication No. 6-258421).

*Primary Examiner*—R. Dean
*Assistant Examiner*—Sikyin Ip
*Attorney, Agent, or Firm*—Fleit, Jacobson, Cohn, Price, Holman & Stern

[57] ABSTRACT

The surface of a metal workpiece is remelted by a heat producing energy beam so as to form a molten metal layer thereon. While remelting the surface, a magnetic field is generated coaxially with the energy beam and is applied across the molten metal layer so as to cause the heat energy to flare and, thereby, produce a Lorentz force in the molten metal layer. By the Lorentz force, the molten metal is agitated. The heat energy and magnetic field are oscillated, or reciprocally moved, relative to the surface so as to cause a flow of the molten metal from the edges of the molten metal layer toward the center, thereby providing a uniform chilled layer thickness.

1 Claim, 5 Drawing Sheets

| | FLUX DENSITY (gauss) | WIDTH (mm) | THICKNESS A (mm) | DEPTH B (mm) | HARDNESS (Hv) | CURRENT (A) |
|---|---|---|---|---|---|---|
| EX. 1 | 390 | 15.1 | 1.8 | 0.30 | 657 | 7 |
| EX. 2 | 280 | 14.5 | 2.1 | 0.325 | 654 | 5 |
| EX. 3 | 170 | 14.2 | 1.9 | 0.30 | 665 | 3 |
| EX. 4 | 0 | 13.8 | 1.3 | 0.275 | 655 | 0 |

METHOD OF FORMING CHILLED LAYER

This invention relates to a method of forming a chilled layer of a workpiece by remelting and hardening treatment an apparatus for performing the method.

BACKGROUND OF THE INVENTION

1. Field of the Invention

Conventionally, it is known to remelt the surface of a workpiece, such as, for example, a cam of a camshaft for driving valves of an automotive engine, for forming a chilled layer in the surface of the workpiece so as to harden the surface. For remelting the surface of the workpiece to thereby form a molten metal layer in the surface, a beam containing heat energy is directed toward the surface. The energy beam is moved entirely or partially over the surface of the workpiece so as to form a molten metal layer on the surface. Specifically the energy beam is oscillated, or reciprocally moved, over the surface, while the workpiece, such as a cam of a camshaft, rotates about its axis of rotation so as to remelt a desired area of the surface of the workpiece, thereby forming a molten metal layer on the surface. The molten metal layer is cooled and hardened, or chilled, with time. As a result, the surface is formed with a hardened, or chilled, layer.

If a thicker chilled layer is to be formed, it is necessary for the energy beam to deliver a high level of heat energy to the surface. However, as the level of heat energy becomes higher, the time required for the molten metal layer to be cooled, or chilled, so as to solidify, becomes longer. Furthermore, because of the effect of gravity and/or of rotation of the workpiece, the molten metal tends to flow before completely solidifying. This results in a non-uniform chilled layer thickness on the surface of the workpiece.

2. Description of Related Art

To provide a uniform chilled layer thickness, an apparatus, such as that which is known from, for example, Japanese Unexamined Patent Publication No. - 60 258421, includes a plasma torch as means for generating a beam containing heat energy, which oscillates, or reciprocally moves, over the surface of the workpiece. A magnetic coil, oriented by the plasma torch, generates a magnetic field in order to cause the energy beam to oscillate between the extreme ends of the molten metal layer to be formed. The energy beam, when the plasma torch reverses the direction of movement at the extreme ends, reduces its speed and stops momentarily, so as to distribute higher heat energy to marginal portions of the surface than to the central portion. Because of this non-uniform distribution of heat energy, the chilled layer formed in the surface of the workpiece is non-uniform in its widthwise thickness. More specifically, the chilled layer is thicker, or deeper, at the opposite marginal portions than at the central portion.

To illustrate this problem more clearly, reference is made to FIG. 1, where the distribution of depth, or thickness, in a transverse direction of a chilled layer, formed on a cam surface of a camshaft by the conventional remelting and hardening treatment, is shown. A chilled layer 3 of the cam surface 2 of the cam 1 has a depth which is deeper at opposite extreme end portions 4, where the energy beam reverses its direction of movement, than at the central portion 6.

SUMMARY OF THE INVENTION

An object of the present invention is to provide a method of forming a uniform chilled layer thickness on a surface of a workpiece by remelting and hardening treatment, and an apparatus for performing the method.

The surface of a metal workpiece is remelted by an energy beam generated by, for instance, a laser, a tungsten inert gas (TIG) arc generator or the like, bearing heat energy so as to form a molten metal layer on the surface of the workpiece. While remelting the surface of the workpiece, a magnetic field is generated coaxially with the energy beam and is applied so as to penetrate the molten metal layer and thereby to flare the heat energy. As a result, a force, known as a Lorentz force, is produced in the molten metal layer, so that the molten metal is agitated, or stirred. Oscillating, or reciprocally moving, both the energy beam and magnetic field over the surface of the work between opposite extreme ends of a layer which is to be chilled causes a flow of the molten metal from the extreme ends of the molten metal layer toward the center, so that the molten metal layer is formed with a uniform thickness and solidifies, forming a chilled layer with a uniform thickness.

In a specific embodiment, means for generating the magnetic field comprises a magnetic coil, such as, in particular, an A.C. electromagnetic coil. The A.C. electromagnetic coil provides a magnetic field which changes alternately in opposite magnetic directions. This alternately changing magnetic field enhances the agitation of molten metal.

BRIEF DESCRIPTION OF THE DRAWINGS

The above and other objects and features of the present invention will be apparent to those skilled in the art from the following description when considered in conjunction with the accompanying drawings, in which.

DESCRIPTION OF THE PREFERRED EMBODIMENT

Figure 1:
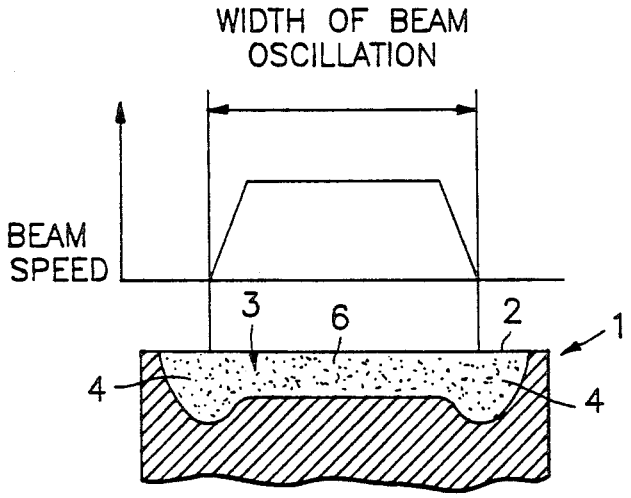
FIG. 1 (PRIOR ART)
FIG. 1 is an explanatory illustration showing a chilled layer on a cam surface of a camshaft formed by a conventional apparatus.
Figure 2:
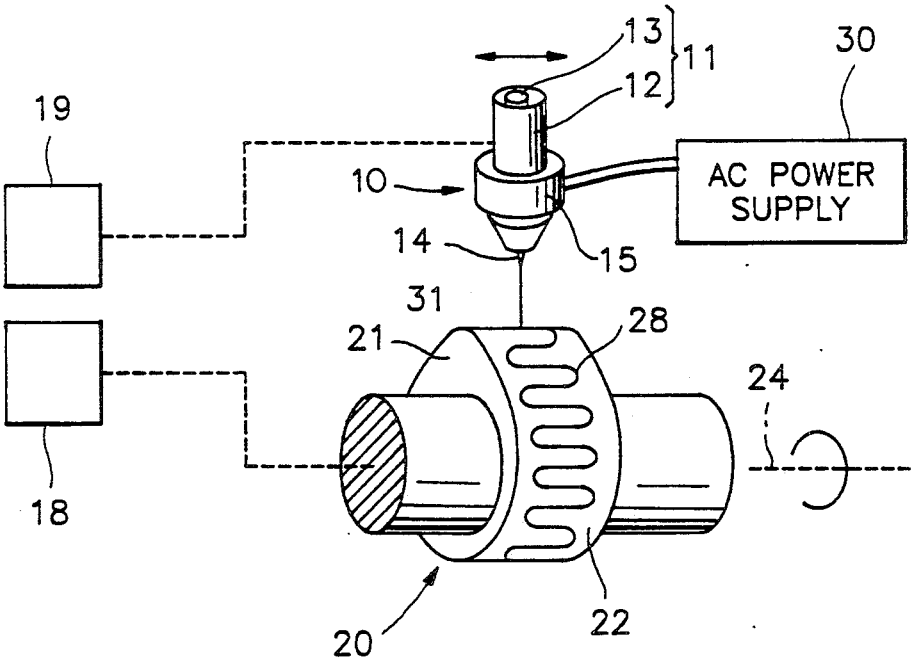
FIG. 2 is a schematic perspective view of an apparatus for forming a chilled layer in accordance with a preferred embodiment of the present invention.

Referring now to the drawings in detail, and in particular, to FIG. 2, an apparatus for forming a chilled layer on a surface of a workpiece by remelting and hardening treatment in accordance with a preferred embodiment of the present invention is shown. The apparatus is shown as used to form a chilled layer in the surface of a cam of a camshaft for, for instance, driving valves of an automotive engine.

The camshaft 20, having cams 21 (only one of which is shown) of ductile iron to be treated and formed with a chilled layer in the cam surface 22, which is roughly ground, is turned at a constant speed about an axis of rotation 24 thereof by a conventional mechanical drive mechanism 18.

The apparatus comprises molten metal layer forming means 10, for melting the cam surface 22 of the cam 21 and agitating, or stirring, the melted metal of the cam surface 22. The molten metal layer forming means 10 comprises a heat energy generator 11, such as a laser beam generator, an electron beam generator, a tungsten inert gas (TIG) arc generator or the like, for generating a beam of heat energy, and a magnetic field generator, such as an A.C. electromagnetic coil 15. The heat energy generator 11, such as a tungsten inert gas (TIG) arc generator (which is hereinafter referred to as a beam torch), has a cylindrical hollow housing 12 and an electrode 13 housed in the housing 12 with its cone-shaped tip 14 projecting outside the housing 12. The electromagnetic coil 15, having a cylindrical hollow coil body, is coaxially mounted on the housing 12 of the beam torch 11. The molten metal layer forming means 10 is oscillated, or reciprocally moved, by a conventional mechanical drive mechanism 19 in a direction of the axis of rotation 24 of the camshaft 20 at a constant speed so as to cause a two dimensional relative movement with respect to the surface 22 of the cam 21 of the camshaft 20. The electromagnetic coil 15 is energized, or magnetized, by an alternating current from an alternating current power supply 30.

The molten metal layer forming means 10, in particular, the electrode 13, when energized, radiates and directs an energy beam 31 to the cam surface 22 of the cam 21 during the relative movement thereof with respect to the cam surface 22 of the cam 21 so as to heat and melt a desired surface area of the cam surface 22 of the cam 21. The molten metal layer 3' solidifies with time, and is hardened, thereby forming a chilled layer 3 (see FIG. 3) in the cam surface 22. The electrode 13 directs the energy beam 31 to the cam surface 22 of the cam 21 rotating about the axis of rotation 24 so as to trace a locus 28, thereby forming the molten metal layer circumferentially over the peripheral surface 22 of the cam 21.

While the electrode 13 is energized and radiates and directs the energy beam 31, the molten metal layer forming means 10 also magnetizes the magnetic coil 15 with the alternating current so as to generate a magnetic field.

Figure 3:
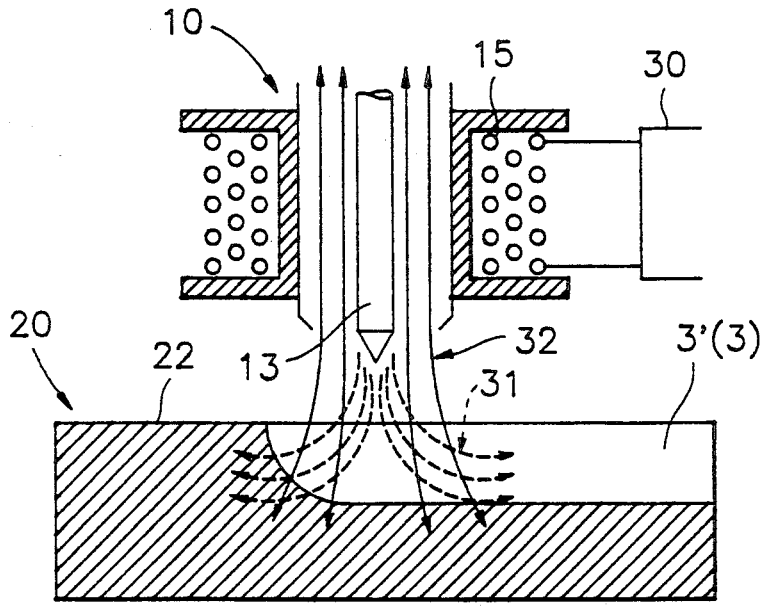
FIG. 3 is an enlarged cross-sectional view of electromagnetic means of the apparatus shown in FIG. 2.
Figure 4:
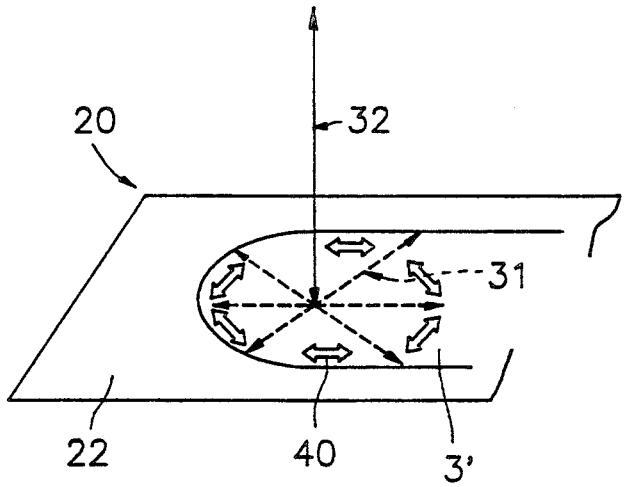
FIG. 4 is an explanatory illustration showing the mechanism for generating a Lorentz force in a molten metal layer.
Figure 5:
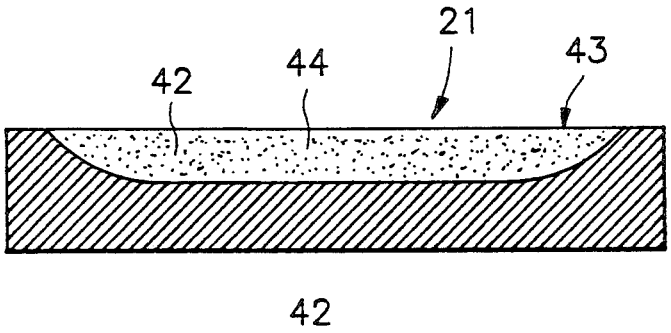
FIG. 5 is a cross-sectional view of a chilled layer formed by the apparatus shown in FIG. 2.

Referring to FIGS. 3 to 5, the magnetic coil 15, when magnetized, generates a magnetic field 32 across the cam surface 22 of the cam 21. The magnetic field 32 interacts with the energy beam 31, causing the energy beam 31 to flare, and thereby generates a force which acts in directions indicated by arrows 40, well known as a Lorentz force, in the melted metal layer 3', as is shown in FIG. 4. While the molten metal of the layer 3' is cooled and solidified, it is agitated, or stirred, by the force 40.

Because the electromagnetic coil 15 generates the magnetic field 38 in opposite directions which change alternately, the force 40 acts on the molten metal layer 3' in opposite, i.e., clockwise and counterclockwise, directions, as viewed in FIG. 4. These directions change alternately. Accordingly, the molten metal is vibrated substantially in a vertical direction and is, therefore, vigorously agitated, or stirred, so that the molten metal layer 3' is more precisely uniform in thickness. Agitating the molten metal with the Lorentz force 40 promotes heat-dissipation more rapidly from the molten metal layer, so as to accelerate the solidification of the molten metal layer 3'.

Moving the electromagnetic means 10 in the axial direction causes a flow of the molten metal from the outer side of molten metal layer 3' toward the center. As a result, although the speed of the energy beam 31 drops, and the beam may momentarily stop, in the axial direction, at the opposite extreme ends of the molten metal layer 3', the molten metal layer 3' becomes uniform in depth, or thickness, so as to form a uniform thickness of chilled layer 3, as is shown in FIG. 5.

Figure 6:
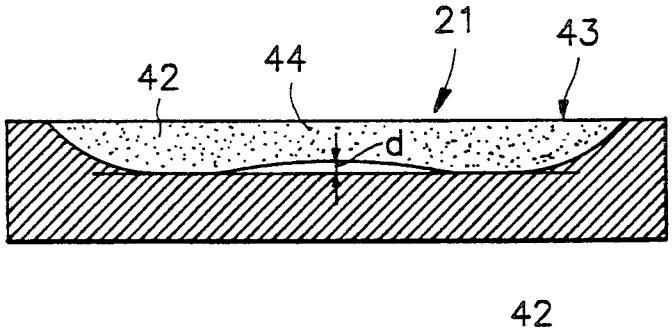
FIG. 6 is a cross-sectional view of a chilled layer experimentally formed for the purpose of evaluating the chilled layers formed by the apparatus shown in FIG. 2.

For more clear understanding, reference is made to FIG. 6, showing a chilled layer 43 formed in the cam surface 22 of the cam 21 by the use of a conventional apparatus which has no magnetic coil. As is clearly seen, the chilled layer 43 is thicker at the opposite extreme side portions 42, where the energy beam drops its speed, or stops, than at the central portion 44, and causes a difference in depth, or thickness, therebetween, which is shown by a reference character d. Comparing the chilled layer 3 shown in FIG. 5 to the chilled layer 43 shown in FIG. 6, the effect of an apparatus in accordance with the present invention is apparent.

Figure 8:
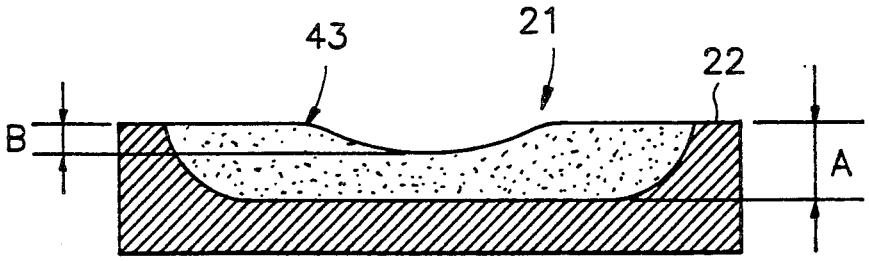
FIG. 8 is an explanatory cross-sectional view of a chilled layer for illustrating evaluation properties, such as the depth, or thickness, of a chilled layer A in a cam top surface and the depth of indentation, or depression, B in the chilled layer.
Figures 7, 9:
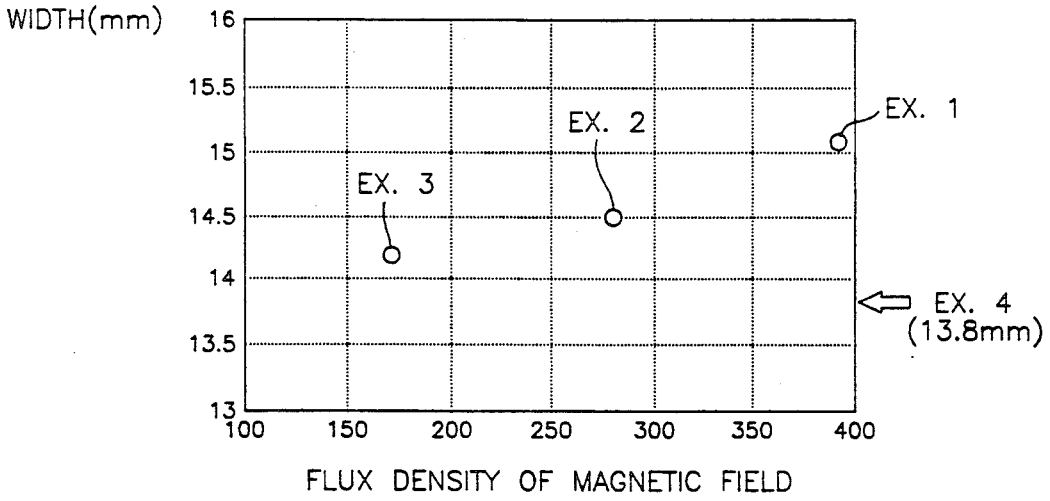
FIG. 7 is a table showing the properties of chilled layers, for various flux densities of magnetic fields, formed by the apparatus shown in FIG. 2.
FIG. 9 is a diagram showing the properties of the chilled layers formed experimentally in terms of correlation between the width of the chilled layer and the flux density of the magnetic field.

Referring to FIGS. 7 to 9, the results of several experiments conducted in order to make a comparison of the invention and a comparative conventional example, are shown. The experiments 1, 2 and 3 were carried out with a sample cam having a width of approximately 17.5 mm which was made of ductile iron and the surface of which was roughly ground. The apparatus used was a device such as a TIG device with an electromagnetic coil. Table I of FIG. 7 exhibits the results of these experiments for different currents of 7, 5 and 3 Amperes (A) so as to generate different flux densities of electromagnetic fields, such as 390, 280 and 170 gauss, respectively. For the comparative conventional example, the same apparatus was used with the same sample, but no electromagnetic field was generated. The electric field was eliminated by shutting down the supply of alternating current to the electromagnetic coil of the TIG device.

The table of FIG. 7 shows the width of the chilled layer of the cam top surface, in mm, the thickness, or depth, A of the chilled layer of the cam top surface from a designed cam top surface (see FIG. 8) in mm, the depth of indentation B of the cam top surface from the designed cam top surface (see FIG. 8), in mm, and the hardness of chilled layer of the cam top surface, in Hv units, for each experiment.

As apparent from the table of FIG. 7, the width of the chilled layer increasingly varies with an increase in flux densities of the electromagnetic field generated by the electromagnetic coil. Changes in thickness or depth A of the chilled layer, the depth of indentation B and the hardness of the chilled layer are small and within a range in which no adverse effects on the function of the cam are caused.

FIG. 9 shows a diagram in terms of the relationship between the flux densities of the electromagnetic field and the width of the chilled layer for the experiments.

Experiments were also conducted in order to determine the optimum range of the A.C. current frequency for atomizing the electromagnetic coil 15 to provide the permissible depth of depression B of the chilled layer and the desirable hardness of the chilled layer.

Figure 10:
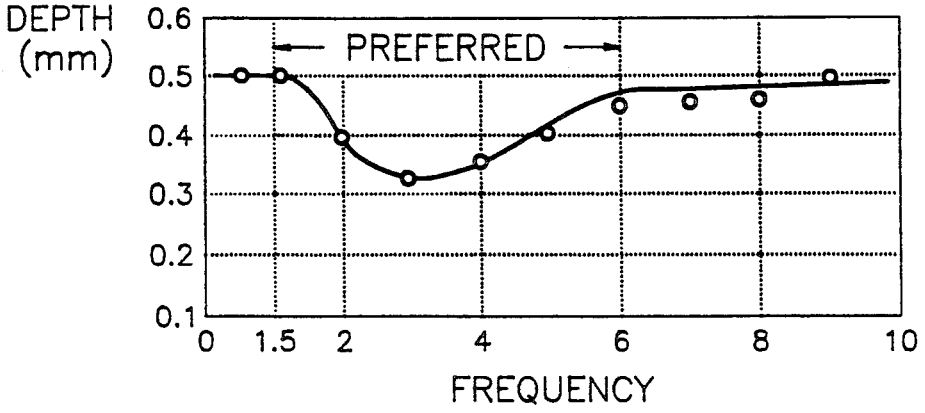
FIG. 10 is a diagram showing the depth of indentation relative to A.C. current frequency.
Figure 11:
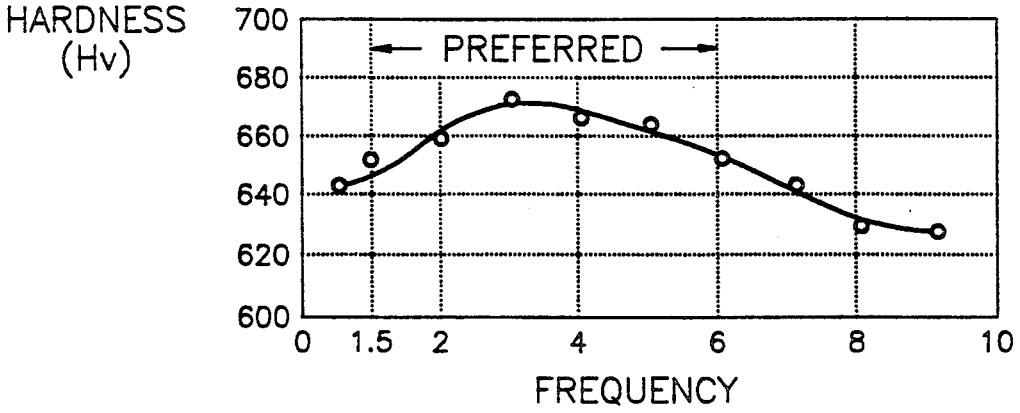
FIG. 11 is a diagram showing the hardness of the chilled layer relative to A.C. current frequency.

Referring to FIGS. 10 and 11, the result of a number of experiments conducted are shown. From an evaluation of the results, the A.C. current frequency is preferably approximately 1.5 and 6.0 Hz. With a frequency under 1.5 Hz, the change in direction of the Lorentz force 40 is insufficient for the molten metal to be agitated and to flow, so that the molten metal does not dissipate heat rapidly. On the other hand, with a frequency over 6.0 Hz, the Lorentz force 40 changes direction too frequently, so as to impede the flow of molten metal. This also causes an stagnation in heat-dissipation.

It is to be understood that although the invention has been described in detail with respect to a preferred embodiment thereof, various other embodiments and variants are possible which fall within the scope and spirit of the present invention, and such embodiments and variants are intended to be covered by the following claims.

What is claimed is:

1. A method of forming a chilled layer in a surface of a workpiece comprising the steps of:

directing an energy beam to remelt the surface with heat so as to form a molten metal layer in the surface;

applying an alternating current having a frequency in the range of approximately one and one half to six Hz to an electromagnetic coil to generate a magnetic field coaxial with said energy beam so as to cause said energy beam to flare, thereby agitating molten metal of the molten metal layer;

causing a predetermined reciprocating movement of said energy beam relative to the surface during remelting of the surface so as to cause a flow of the molten metal from extreme sides of the molten metal layer toward a center of the molten metal layer, thereby providing the molten metal layer with a substantially uniform depth; and cooling and hardening the molten metal, thereby forming a chilled layer of uniform thickness.

* * * * *